US010071789B2

(12) United States Patent
Gillette

(10) Patent No.: US 10,071,789 B2
(45) Date of Patent: Sep. 11, 2018

(54) BOW STEP AND SEAT BACK FOR INFLATABLE BOATS

(71) Applicant: Glenn Gillette, Hialeah, FL (US)

(72) Inventor: Glenn Gillette, Hialeah, FL (US)

( * ) Notice: Subject to any disclaimer, the term of this patent is extended or adjusted under 35 U.S.C. 154(b) by 0 days.

(21) Appl. No.: 15/428,213

(22) Filed: Feb. 9, 2017

(65) Prior Publication Data

US 2017/0225748 A1 Aug. 10, 2017

Related U.S. Application Data

(60) Provisional application No. 62/293,529, filed on Feb. 10, 2016.

(51) Int. Cl.

| | |
|---|---|
| ***B63B 7/00*** | (2006.01) |
| ***B63B 7/08*** | (2006.01) |
| ***B63B 27/00*** | (2006.01) |
| ***B63B 29/04*** | (2006.01) |
| ***B63B 17/00*** | (2006.01) |

(52) U.S. Cl.

CPC ..... *B63B 7/085* (2013.01); *B63B 7/082* (2013.01); *B63B 17/00* (2013.01); *B63B 27/00* (2013.01); *B63B 29/04* (2013.01); *B63B 2029/043* (2013.01)

(58) Field of Classification Search

CPC ..... B63B 29/04; B63B 17/00; B63B 27/00; B63B 7/085; B63B 7/082

USPC ..... 114/362, 363

See application file for complete search history.

(56) References Cited

U.S. PATENT DOCUMENTS

| | | | | |
|---|---|---|---|---|
| 5,224,891 | A * | 7/1993 | Stephens | A47C 15/006 114/363 |
| 2004/0177798 | A1* | 9/2004 | Charles | B60N 2/2839 114/363 |
| 2011/0132252 | A1* | 6/2011 | Kaye | B63B 7/085 114/362 |
| 2015/0375644 | A1 | 12/2015 | Gratz | |

(Continued)

OTHER PUBLICATIONS

AB Inflatables 2016 Online Catalog. Pictures 19, 21-22, 29. Visited http://www.abinflatablesusa.com Feb. 6, 2016.

(Continued)

*Primary Examiner* — Stephen P Avila

(74) *Attorney, Agent, or Firm* — Cara C. Morris; Joseph R. Carvalko, Jr.

(57) ABSTRACT

This invention relates to a generally molded fiberglass apparatus that serves a multipurpose function for inflatable boats. The apparatus attaches to the bow of the boat and includes a forward passenger seat with a backrest and optionally servers to provide a step for embarking or disembarking the boat at the bow, and location for affixing one or more marine navigational or safety devices or accessories. The invention is affixed to the inner bow section of the passenger area to an inflatable tubular member craft by a permanent or semi-permanent means including, but not limited to clamps, adhesives, bolts, clips, snaps, ties, ratchets, or a combination thereof. The apparatus is shaped to conform to the topside bow curvature of the inflatable boat and to the adjacent concave curvature on the substantially vertical section within the passenger area at the bow of the inflatable boat, utilizing the craft's structure as the seated area.

11 Claims, 2 Drawing Sheets

(56) References Cited

U.S. PATENT DOCUMENTS

2016/0001853 A1* 1/2016 Khieowan ..... B60N 2/167
114/363

OTHER PUBLICATIONS

Zodiac Nautic 2016 Online Catalog. pp. 1, 2. Visited www.avonmarine.com Dec. 22, 2016.

* cited by examiner

BOW STEP AND SEAT BACK FOR INFLATABLE BOATS

CROSS-REFERENCE TO RELATED APPLICATIONS

This is a continuation-in-part claiming the priority benefit under 35 U.S.C. 119(e) of U.S. Provisional Application No. 62/293,529 filed Feb. 10, 2016, the entire disclosure of which is hereby incorporated by reference.

FIELD OF THE INVENTION

This invention relates to devices for securing passengers and allowing for safer boarding of inflatable boats having limited space and for locating and affixing marine navigational or safety devices or accessories.

BACKGROUND OF THE INVENTION

Inflatable boats have been becoming increasingly popular, used for military, para military and recreation transportation. These boats are relatively lightweight, thus facilitating transporting thereof and, when deflated, some boats can be folded for more convenient storage. Also, some inflatable boats are simple and inexpensive to manufacture and hence are more economically feasible for the consumer.

One drawback with inflatable boats involves the provision of secure seating for passengers, and ease of boarding. Usually a passenger sits on the tubular walls that form the hull, and includes the topside areas along the port, starboard, stern and bow. These boats operate at high speeds and in rough waters, making sitting on the tubular walls dangerous. This is especially true for children and others unable to hold fast on handles that are often part of the tubular walls. Inflatable boats may include one or more seats that extend transversely within the boat at a desired locations, but often these seats occupy what otherwise would be storage space. Additionally, in the event that inflatable boats are used in shallow water rescue operations, the boats fail to provide a simple means for boarding and thereafter securing a victim, especially in the event the victim is unconscious. What is needed then, is way of improving passenger comfort and safety.

SUMMARY OF THE INVENTION

This invention relates to an apparatus that serves a multipurpose function for inflatable boats. The apparatus attaches to the bow of the boat and includes a backrest and optionally servers to provide for one or more of a step for embarking or disembarking the inflatable boat at the bow, a location for affixing marine navigational or safety devices or accessories, by way of example and not limitation, a cleat or a navigational light.

More particularly, the invention pertains to a molded apparatus for a boat having an inflatable tubular hull structure including a backrest conformable to the bow of the boat that provides for one of a step for embarking or disembarking the boat at the bow; a curved peripheral edge integral to the backrest conforming to the positive curved portion on a topside portion of the tubular hull; the backrest and the curved peripheral edge forming a concave central portion of a seating area; a top section integral to the backrest and peripheral edge extending to the distal end of the bow for placement of one of marine navigational or safety devices.

In yet another embodiment the molded apparatus is affixed to an inner bow section of a passenger area of the tubular hull by one of clamps, adhesives, bolts, clips, snaps, ties, or ratchets. Further the molded apparatus may be further shaped to conform to the topside convex bow curvature of the inflatable boat and to the adjacent concave curvature on a substantially vertical section.

DETAILED DESCRIPTION OF THE INVENTION

Figure 1:
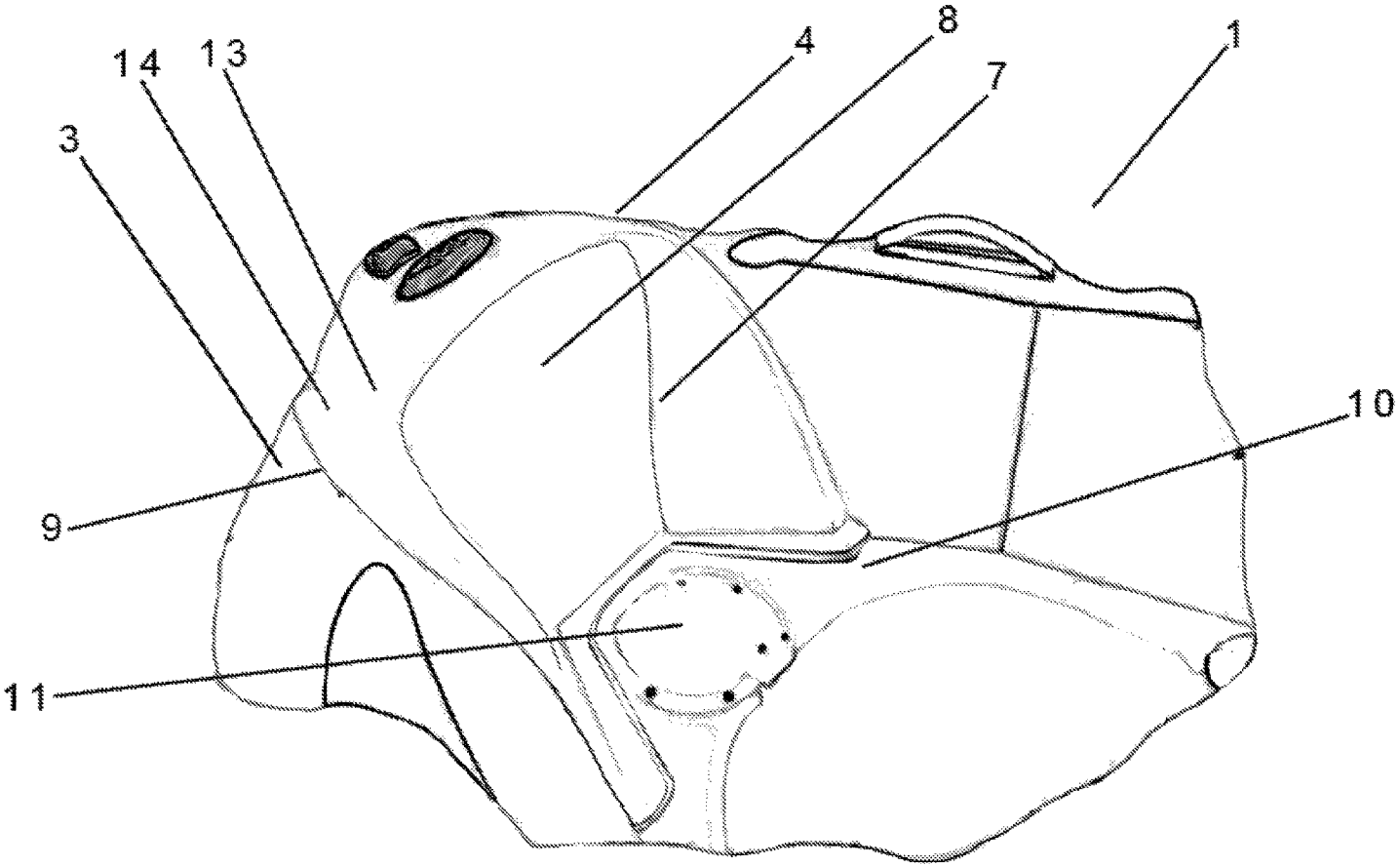
FIG. 1 is a perspective view illustrating the craft and an insertable bow step and seat back apparatus in accordance with an embodiment of the invention.

The following detailed description includes the best mode of carrying out the invention and is made for the purpose of illustrating the general principles of the invention and should not be taken in a limiting sense. The scope of the invention is determined by reference to the claims. Each part or function is assigned, even if structurally identical to another part, a unique reference number wherever that part is shown in the drawing figures.

In one non limiting embodiment a molded apparatus for a boat, formed from an inflatable tubular hull structure, includes a one-piece insertable accessory for converting an inner passenger area of the bow of the boat to one of an aft facing insertable accessory. The accessory is thereafter utilized as one of a step from the bow of the boat or as a seat facing the craft operator station. On the upper part of the apparatus, a surface integral to the assembly is utilized to mount one of a navigational or safety device or other functional or ornamental features that may be deemed desirable.

Figure 2:
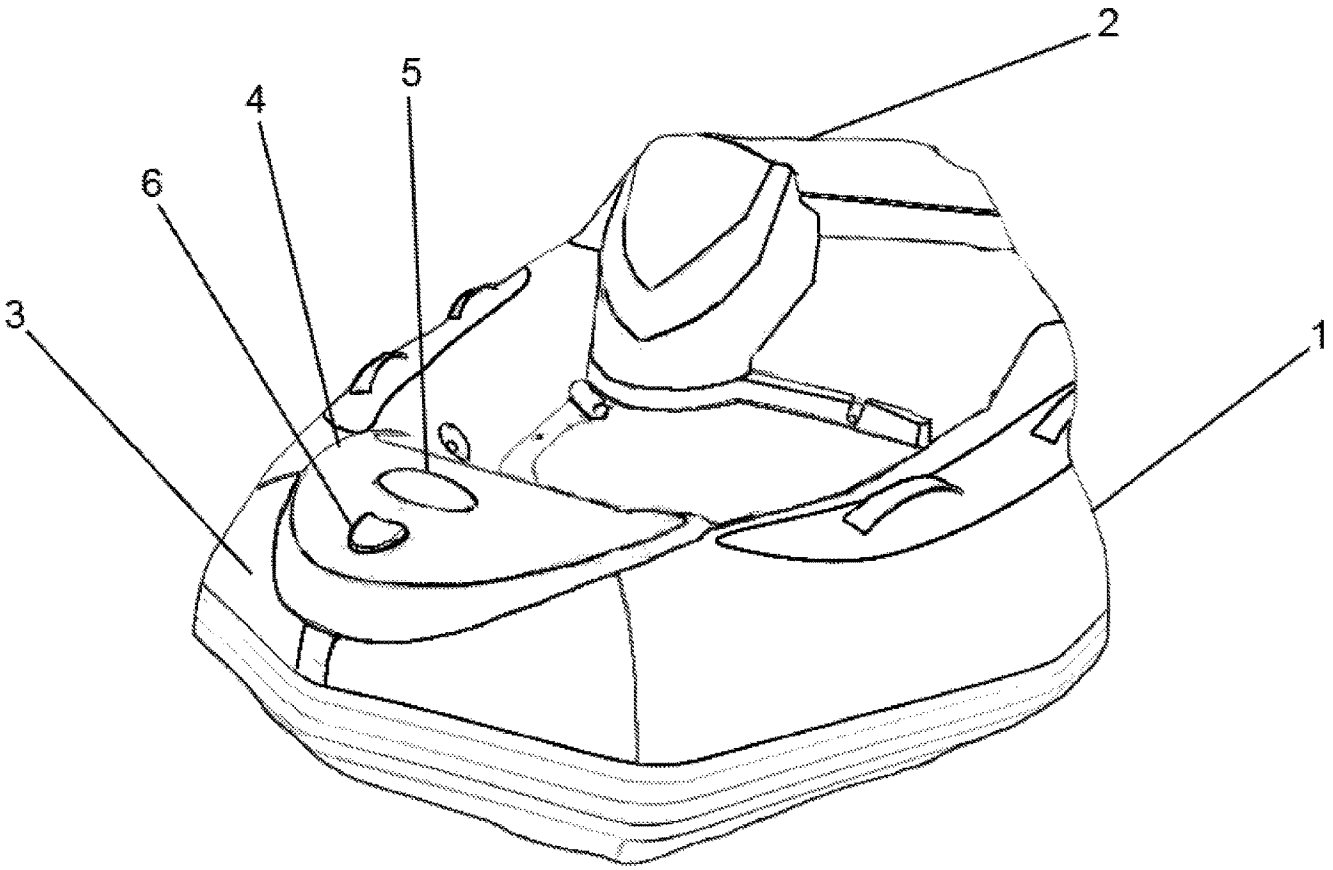
FIG. 2 is a perspective view illustrating the craft and an insertable bow step and seat back apparatus in accordance with an embodiment of the invention.

More specifically and referring to FIG. 1 and FIG. 2, the invention disclosed herein relates to an inflatable boat 1 apparatus, including a one-piece insertable accessory 4 resting on a base 10, having a concave central portion 8 defining a recessed back rest, a curved peripheral edge 14 surrounding the concave central portion 8; said peripheral edge 14 conforming to the positive curved portion 9 of the boat tubular wall 1 inflatable tubular member 3, and arcuately extend to surround a substantially flat surface 13, for affixing one or more of a marine navigational or safety device such as a cleat 5 and a navigational light 6, wherein the one-piece body insertable accessory 4 converts an inner passenger area of the bow of said boat 1 to one of an aft facing insertable accessory 4, facing the craft operator 2 station, and serving the multiple use of securing a passenger or as a firm step 11 onto the bow of the boat 1 or serving as a location for affixing one or more of marine navigational or safety devices or accessories. In another embodiment, the central portion 8 is a substantially flat surface. The seat may be constructed through a variety of processes and techniques, such as molded fiberglass, fiberglass reinforced plastic, injection molding, thermoforming, 3D printing, additive manufacturing, metal forming, as well as utilizing adhesives, mating parts or other means of joining or molding materials. The molded apparatus of the invention may be molded into a hull portion of the boat. Such processes and techniques are well-known to those skilled in the art of manufacturing and assembling two-dimensional and threedimensional shaped fixtures constructed from metals, fiberglass, plastics and recyclable materials.

In yet another embodiment of the invention a method creates a multi-purpose apparatus for a boat having an inflatable tubular hull structure including: conforming a ridged backrest to the bow of the boat to provide for one of a step for embarking or disembarking the boat at the bow; conforming a peripheral edge integral to the backrest to the positive curved portion on a topside portion of the tubular hull; forming a concave central portion of a seating area as a result of the backrest and the curved peripheral edge; extending to the distal end of the bow for placement of one of marine navigational or safety devices to top section integral to the backrest and peripheral edge. The method also includes by way of example and not limitation, further affixing the backrest and the peripheral edge to an inner bow section of the tubular hull by one of clamps, adhesives, bolts, clips, snaps, ties, or ratchets. An embodiment of the inventive method also includes by way of example and not limitation further shaping the backrest and the peripheral edge to conform to the topside convex bow curvature of the inflatable boat and to the adjacent concave curvature on a substantially vertical section.

While the foregoing invention has been described with reference to the above embodiments, additional modifications and changes can be made without departing from the spirit of the invention. Accordingly, such modifications and changes are considered to be within the scope of the appended claims.

I claim:

1. A molded apparatus comprising:

A. a boat having an inflatable tubular hull structure including:

a. a backrest conformable to a bow of the boat that provides for one of a step for embarking or disembarking the boat at the bow;

b. a curved peripheral edge integral to a backrest conforming to a positive curved portion on a topside portion of the inflatable tubular hull;

c. the backrest and a curved peripheral edge forming a concave central portion of a seating area;

d. a top section integral to the backrest and the curved peripheral edge extending to the distal end of the bow for placement of one or more of marine navigational or safety devices.

2. The molded apparatus of claim 1, wherein the apparatus is affixed to an inner bow section of a passenger area of a tubular hull by one of clamps, adhesives, bolts, clips, snaps, ties, or ratchets.

3. The molded apparatus of claim 1, wherein the apparatus is shaped to conform to the topside convex bow curvature of the inflatable boat and to the adjacent concave curvature on a substantially vertical section.

4. The molded apparatus of claim 1, wherein the backrest and the curved peripheral edge forming a substantially flat central portion.

5. The molded apparatus of claim 1, wherein the apparatus is one of fiberglass or fiberglass reinforced plastic.

6. The molded apparatus of claim 1, wherein the apparatus is molded into a hull portion of the boat.

7. A molded apparatus comprising:

A. a boat having an inflatable tubular hull including:

a. a one-piece insertable accessory for converting an inner passenger area of a bow of the boat to one of an aft facing insertable accessory;

b. the accessory utilized as one of a step from the bow of the boat or as a seat facing the boat operator station;

c. a surface integral to the accessory utilized to mount one or more of a navigational or safety device.

8. A method for creating a multi-purpose apparatus for a boat having an inflatable tubular hull structure comprising:

A. conforming a ridged backrest to a bow of the boat to provide for one of a step for embarking or disembarking the boat at the bow;

B. conforming a peripheral edge integral to the backrest to a positive curved portion on a topside portion of the tubular hull;

C. forming a concave central portion of a seating area as a result of the backrest and the curved peripheral edge;

D. extending to the distal end of the bow for placement of one or more of marine navigational or safety devices to a top section integral to the backrest and peripheral edge.

9. The method of claim 8, forming a substantially flat central portion of the seating area as a result of the backrest and the curved peripheral edge.

10. The method of claim 8, further affixing the backrest and the peripheral edge to an inner bow section of the tubular hull by one of clamps, adhesives, bolts, clips, snaps, ties, or ratchets.

11. The method of claim 8, further shaping the backrest and the peripheral edge to conform to the topside convex bow curvature of the boat and to the adjacent concave curvature on a substantially vertical section.

* * * * *